US009604494B1

(12) United States Patent
Valencia

(10) Patent No.: US 9,604,494 B1
(45) Date of Patent: Mar. 28, 2017

(54) PROP FLOWER AND METHOD OF MANUFACTURE

(71) Applicant: Maximiliano Valencia, San Antonio, TX (US)

(72) Inventor: Maximiliano Valencia, San Antonio, TX (US)

( * ) Notice: Subject to any disclaimer, the term of this patent is extended or adjusted under 35 U.S.C. 154(b) by 174 days.

(21) Appl. No.: 14/671,649

(22) Filed: Mar. 27, 2015

(51) Int. Cl.
*A41G 1/00* (2006.01)
*B44C 5/06* (2006.01)

(52) U.S. Cl.
CPC ..... *B44C 5/06* (2013.01)

(58) Field of Classification Search
CPC ..... A41G 1/00
See application file for complete search history.

(56) References Cited

U.S. PATENT DOCUMENTS 2,092,464 A * 9/1937 Matthews ..... A41G 1/00 156/61
4,789,572 A * 12/1988 Weaver ..... A41G 1/00 156/61
5,741,562 A * 4/1998 Scatterday ..... A41G 1/00 156/61
5,955,158 A * 9/1999 Wilkins ..... A41G 1/00 156/61

* cited by examiner

*Primary Examiner* — Jeff Aftergut

(74) *Attorney, Agent, or Firm* — Wayne J. Colton, Inc.

(57) ABSTRACT

A method for construction of a realistically formed and moisture resistant prop flower includes the steps of providing a rigid ball supported atop a tubular member; affixing first panel over and about the tubular member and the rigid ball and, thereafter, affixing a number of additional panels over and about the first panel; and shaping at least a portion of each panel into petals by alternately applying heated air and ambient temperature air. Each panel is constructed of a fine, closed-cell foam material. The panel may be formed as a cinquefoil, quatrefoil or trefoil. The rigid ball is constructed of closed-cell extruded polystyrene foam and the tubular member is constructed of polyvinyl chloride. Following the shaping step, the method includes the step of applying a a synthetic rubber coating to exposed areas of the panels.

10 Claims, 15 Drawing Sheets

PROP FLOWER AND METHOD OF MANUFACTURE

FIELD OF THE INVENTION

The present invention relates to the theatrical arts. More particularly, the invention relates to the manufacture of a prop flower having grossly enlarged scale, yet realistic form.

BACKGROUND OF THE INVENTION

Theatrical props are widely utilized to represent ordinary manufactured objects in exaggerated or odd sizes or naturally occurring live objects in permanent form. On such object for which both requirements often exist is a flower. Although much effort has been devoted to this popular element, past implementations leave much to be desired. In the first place, readily manufactured examples tend to be identical and therefore, in practice, look anything but natural. Custom products, on the other hand, tend not to be well formed and generally do not withstand the elements, precluding outdoors use.

With the shortcomings of the prior art clear in mind, and in the face of long felt but unfulfilled need for improvement, it is an overriding object of the present invention to improve over the prior art by providing a realistically shaped prop flower that can be produced in grossly oversized proportion.

It is yet a further object of the present invention, however, to provide such a prop flower that is also generally impervious to the elements and which can be expected to have a long useful life.

Finally, is an object of the present invention to provide such a prop flower that is readily susceptible to variation such as would be expected in nature, thereby ensuring that the resulting prop flower is suitable for any production or occasion, even where multiple prop flowers are to be displayed or otherwise used side by side or in close proximity.

SUMMARY OF THE INVENTION

In accordance with the foregoing objects, the present invention—a method for construction of a realistically formed and moisture resistant prop flower—generally comprises the steps of: providing a rigid ball dependently supported atop a tubular member extending therefrom; affixing an interior, base panel over and about the tubular member and the rigid ball and, thereafter, affixing a plurality of outer panels over and about the interior, base panel; and shaping at least a portion of the interior, base panel and each outer panel into petals by alternately applying heated air and ambient temperature air to each portion being shaped. In a critical aspect of the present invention, the interior, base panel and each outer panel comprises a fine, closed-cell foam material having a substantially smooth outer surface, such as, for example, tightly cross-linked polyethylene foam.

The interior, base panel most preferably comprises a cinquefoil, but in at least some implementations may comprise a trefoil or quatrefoil. The rigid ball preferably comprises a plastic material, such as closed-cell extruded polystyrene foam. The tubular member preferably comprises polyvinyl chloride.

In at least the most preferred implementations of the present invention, the method for construction further comprises the step, following the shaping step, of applying a flexible coating to exposed areas of interior, base panel and each outer panel. The applied flexible coating preferably comprises a synthetic rubber coating.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Figure 1:
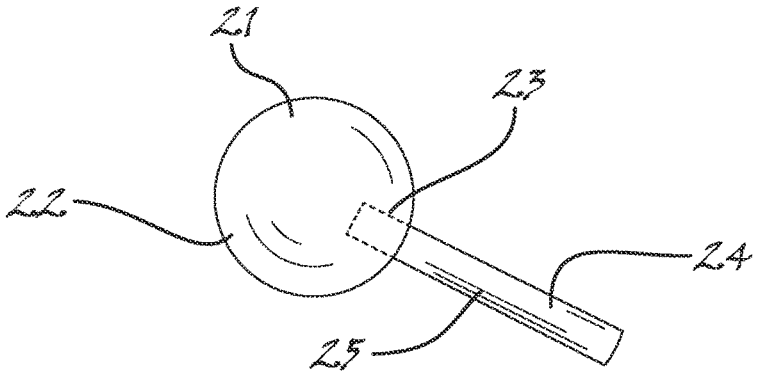
FIG. 1 shows, in a perspective view, a base form, about which the prop flower of the present invention may be shaped, with a mounting pole affixed thereto.

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Referring now to the figures, the prop flower 20 of the present invention, which in the most preferred implementations of the invention is formed as a rose, generally comprises a base form 21, about which the prop flower 20 is formed; an interior, base panel 28 of foam material; and a plurality of outer panels 31 of foam material; and wherein the panels 28, 29 are cooperatively adapted to form the various petal structures of the prop flower 20.

As particularly shown in FIG. 1, the base form 21 most preferably comprises a rigid ball 22 of about 6 inches to about 8 inches in diameter at the scale of implementation chosen for this exemplary only description. Although other shapes may be utilized in a particular implementation, it is noted that the depicted ball shape is generally preferred because, as will be better understood further herein, the base form 21 will take the role of the ovary of the prop flower 20 in its construction and display. Additionally, in order to ensure maximum compatibility with other preferred materials of construction, the rigid ball 22 is preferably manufactured of a plastics material such as, for example, closed-cell extruded polystyrene foam such as that which is commercially available from The Dow Chemical Company of Midland, Mich. under its famous trademark "STYROFOAM."

As also shown in FIG. 1, a mounting pole 24 is also provided in connection with the rigid ball 22, which, as will be better understood further herein, will take the role of a stem in the construction and utilization in display of the prop flower 20. As depicted, the mounting pole may comprise a readily available tubular section 25 manufactured of polyvinyl chloride ("PVC") and measuring, according to this exemplary only description, about 1.5 inches in diameter and 10 inches long. Consistent with this provision, the rigid ball 22 is provided with a bore 23 of about 1.5 inches in diameter and 2 to 3 inches deep. In any case, one end of the tubular section 25 is inserted into the provided bore 23 and thereafter fixed in place with a compatible adhesive, the many choices of which are well within the ordinary skill in the art.

Figure 2:
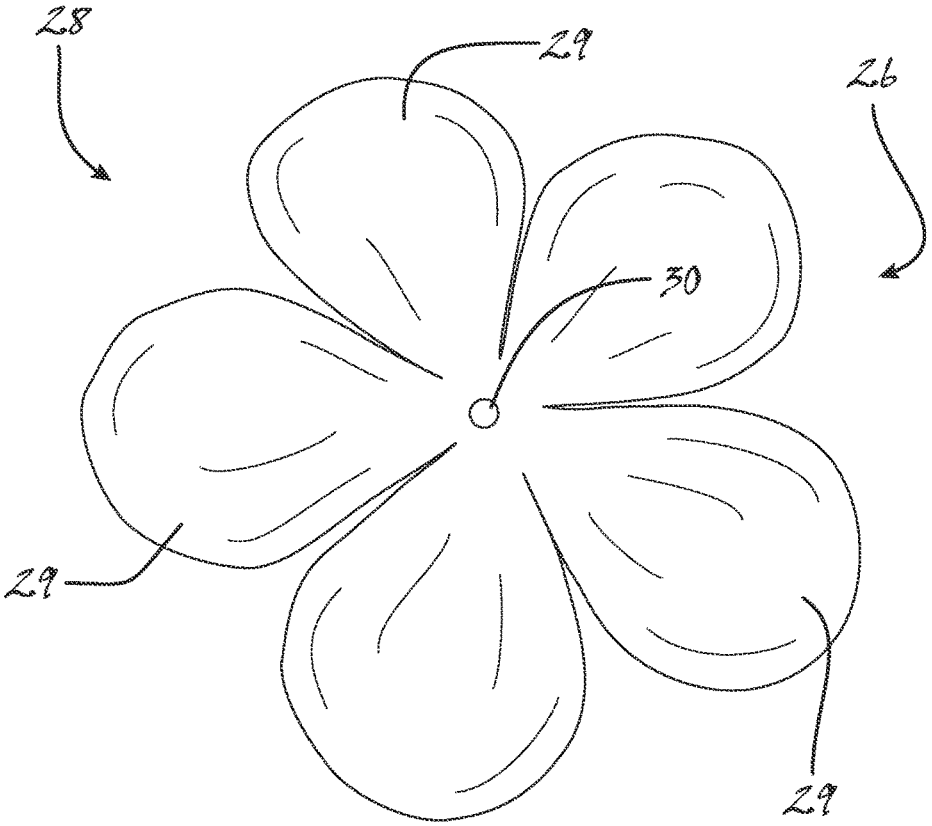
FIG. 2 shows, in a top view, an exemplary interior base panel of flexible foam as prepared for utilization in forming the upper pistil and interior petals of the prop flower.

As previously touched upon, a plurality of flexible foam panels 26 are cooperatively adapted to take the role of the various petal structures in the finally formed prop flower 20 of the present invention. In particular, as shown in FIG. 2, a first foam panel 26 is cut out or otherwise formed as an interior, base panel 28. As depicted in the figure, the interior base panel 28 preferably comprises at least five radially extending petals 29 to form a cinquefoil panel, but in the case of a smaller prop flower 20 may comprise four panels to form a quatrefoil panel or even as few as three panels to form a trefoil panel. In any case, as will be better understood, the cinquefoil or similarly patterned interior, base panel 28 will form the upper pistil and interior petals of the prop flower 20. To this end, each radially extending petal 29 of the interior, base panel 28 is most preferably generally egg shaped. In order to facilitate manufacture of the prop flower 20 of the present invention, the interior, base panel 28 is also provided with a central orifice of size and shape generally corresponding to the circular cross section of the tubular section 25 forming the provided mounting pole 24.

Figure 3:
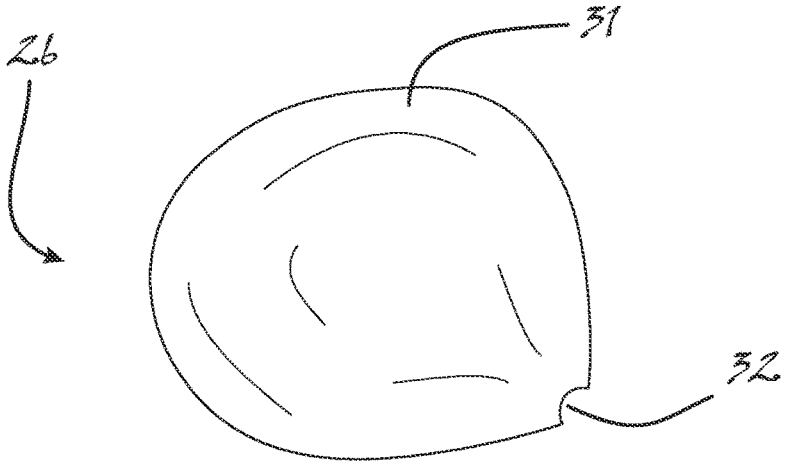
FIG. 3 shows, in a top view, an exemplary outer panel of flexible foam as prepared for utilization in forming the individual outer petals of the prop flower.

Additionally, as shown in FIG. 3, a plurality of other foam panels 26 are cut out or otherwise formed into outer panels 31, each being forming a single generally egg shaped petal of larger size than the radially extending petals 29 of the interior, base panel 28. As will be better understood further herein, these outer panels 31 will form the individual outer petals of the prop flower 20. In order to facilitate manufacture of the prop flower 20 of the present invention, each outer panel 31 is provided with a generally arcuate notch 32 at the narrow end of the panel 31.

Figure 4:
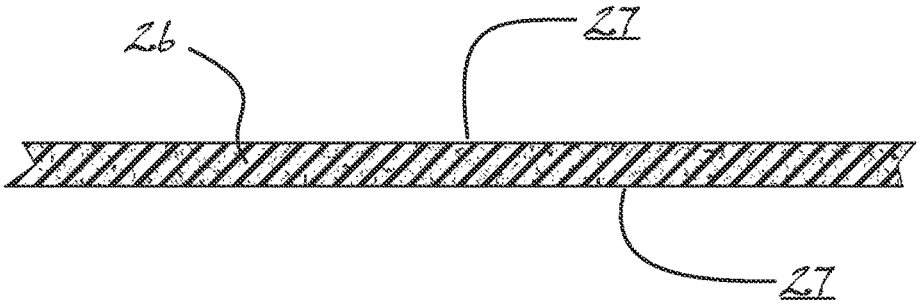
FIG. 4 shows, in a cross-sectional view, various details of the interior structure and outer surfaces of the foam utilized in the construction of the interior base panel of FIG. 2 and the outer panel of FIG. 3.

In order to work the flexible foam panels 26, Applicant has discovered that under the scale of the exemplary implementation herein described each flexible foam panel 26 is best manufactured from foam stock of about 0.25 inches thick, although stock as thin as 0.125 inches thick may be adequately utilized at least in implementation of a much smaller prop flower. In any case, and as a critical aspect of the present invention, each flexible foam panel 26 of the present invention should be constructed of a fine, closed-cell foam with a generally smooth outer surface 27, as particularly shown in FIG. 4. To this end, Applicant has found suitable the cross-linked polyethylene foam commercially available from Sekisui America Corporation of Lawrence, Mass. under its well-known trademark "VOLARA."

Figure 5:
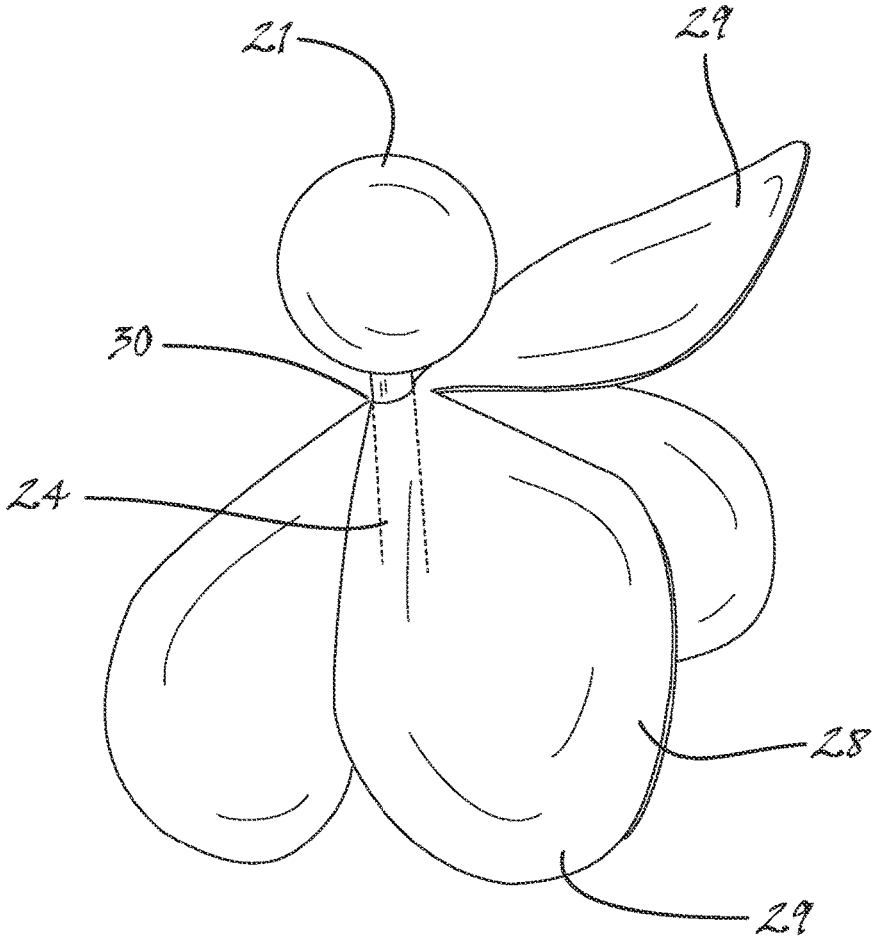
FIG. 5 shows, in a side perspective view, details of the initial application of the interior base panel of FIG. 2 to the base form and mounting pole of FIG. 1.

Referring now to FIGS. 5 through 17, the preferred manufacture of the prop flower 20 of the present invention is detailed step by step. To begin, as shown in FIG. 5, the interior, base panel 28 is positioned such that the central orifice 30 of the interior, base panel 28 circumscribes the mounting pole 24 extending from the base form 21 and the interior, base panel 28 is located just below the base form 21. In this position or, if desired, prior to the previous step, the portion of at least one radially extending panel 29 adjacent to the central orifice 30 and extending outward approximately one quarter of the circumference of the base form 21, as well as the corresponding area of the base form 21, is coated with a contact type spray adhesive. With respect to the materials of construction of the prop flower 20, the contact type spray adhesive utilized should exhibit high initial grab but also have sufficient open time to properly position the materials, as will be better understood further herein. Although any substantially equivalent adhesive may be utilized in a particular implementation, Applicant has found suitable the multipurpose spray adhesive commercially available from 3M Company of St. Paul, Minn. under its well-known trademark "SUPER 77."

Figure 6:
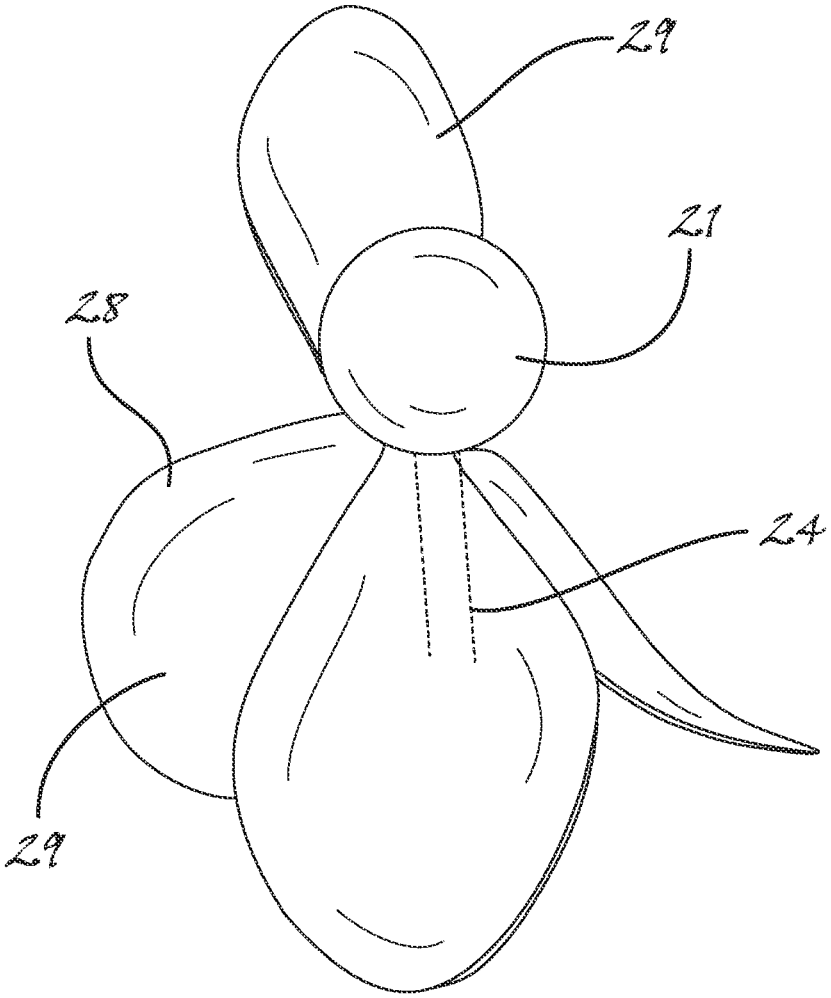
FIG. 6 shows, in a side perspective view corresponding to that of FIG. 5, additional details of the application of the interior base panel of FIG. 2 to the base form of FIG. 1 and, in particular, details of the initial conformance of a petal of the base panel to the rigid ball of the base form.
Figure 7:
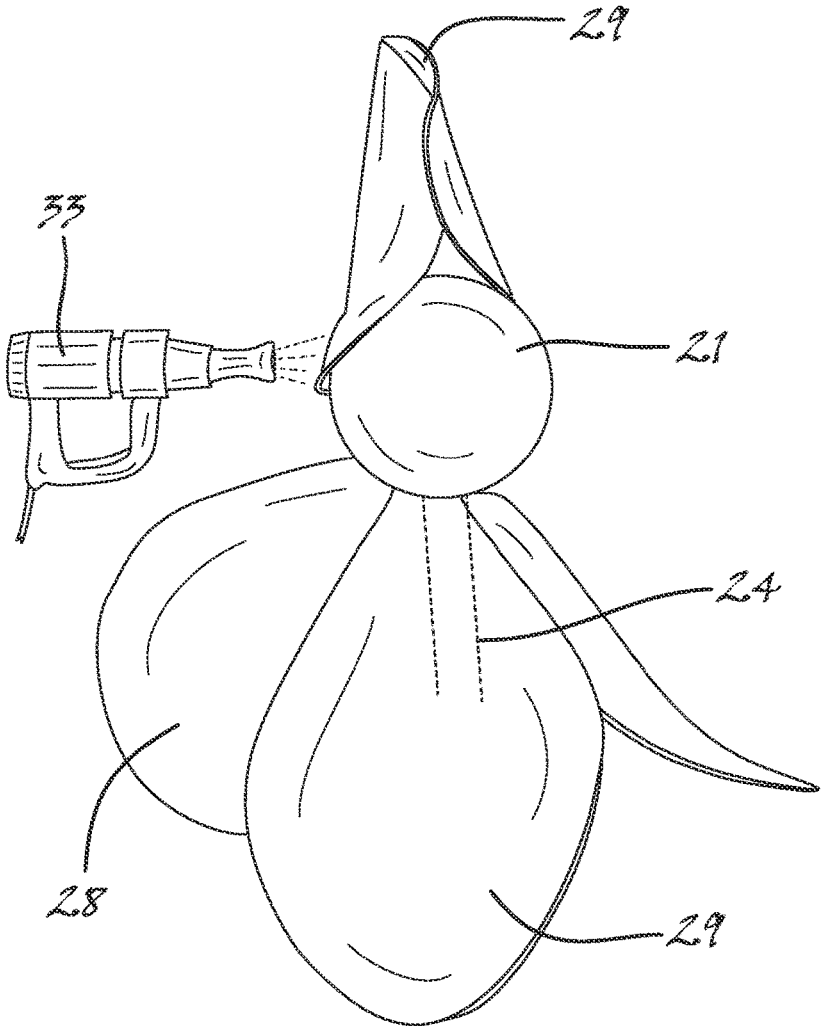
FIG. 7 shows, in a side perspective view corresponding to that of FIGS. 5 through 6, additional details of the application of the interior base panel of FIG. 2 to the base form of FIG. 1 and, in particular, further details of the conformance of the previously depicted petal of the base panel to the rigid ball of the base form.
Figure 8:
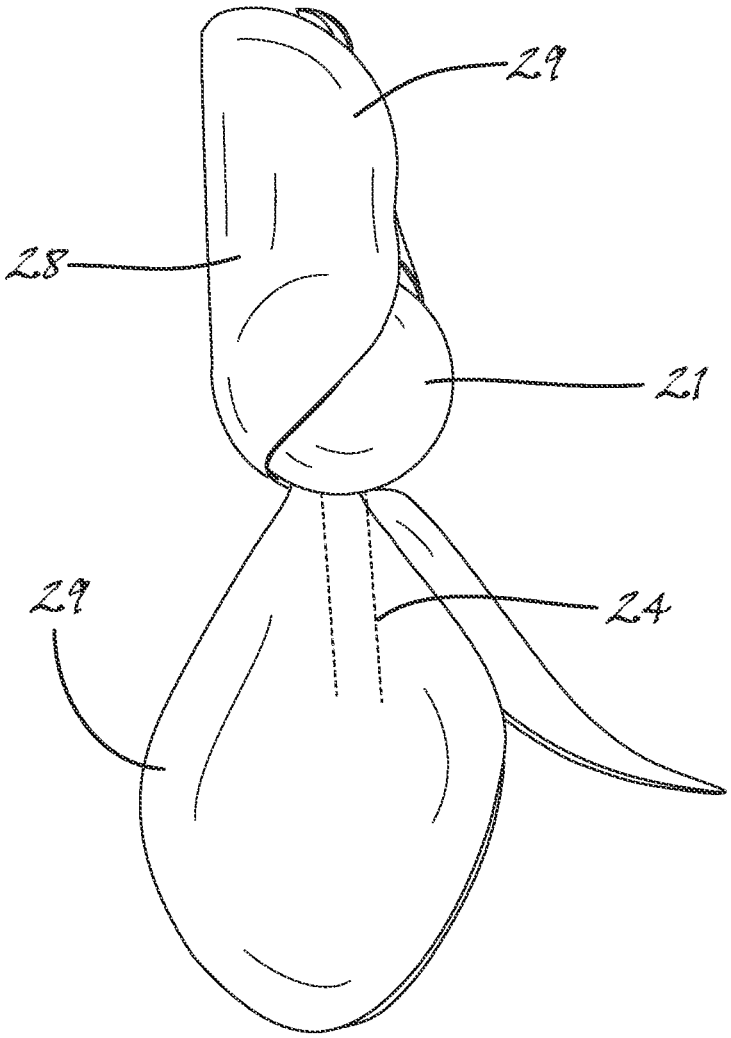
FIG. 8 shows, in a side perspective view corresponding to that of FIGS. 5 through 7, additional details of the application of the interior base panel of FIG. 2 to the base form of FIG. 1 and, in particular, details of the conformance of further petals of the base panel to the rigid ball of the base form.
Figure 9:
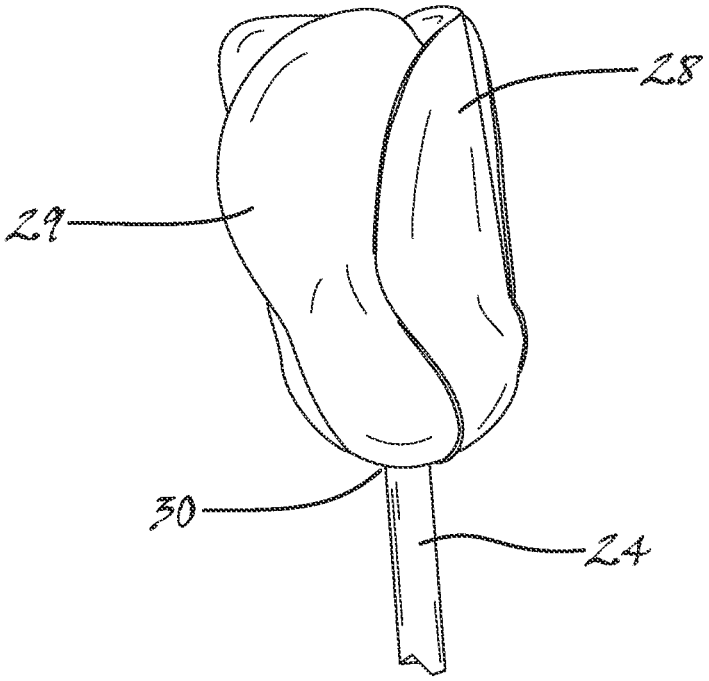
FIG. 9 shows, in a side perspective view corresponding to that of FIGS. 5 through 8, additional details of the application of the interior base panel of FIG. 2 to the base form of FIG. 1 and, in particular, the state of the construction of the prop flower where all petals of the base panel are initially conformed about the rigid ball of the base form preparatory to initial placement of the outer panels.

In any case, when the surfaces are treated with the spray adhesive as recommended by the manufacturer's instructions, the prepared radially extending panel 29 is upwardly positioned as depicted in FIG. 6 and one interior vertical edge and the opposite exterior vertical edge is also treated with the spray adhesive. With the edges treated as described, the radially extending panel 29 is then folded into the closed shape as shown in FIG. 7 and a heat gun 33 is utilized to heat and smooth the critically selected material of the radially extending panel 29 about the base form 21. As will be appreciated in light of this exemplary discussion, this first radially extending panel 29 will form the upper pistil of the finished prop flower 20. In any case, as particularly shown in FIG. 8, each successive radially extending panel 29 is similarly adhered to the base form 21 and adjacent radially extending panels 29 and smoothed utilizing manual manipulation under the flow of heated air. This process continues until the structure of FIG. 9 is obtained.

Figure 10:
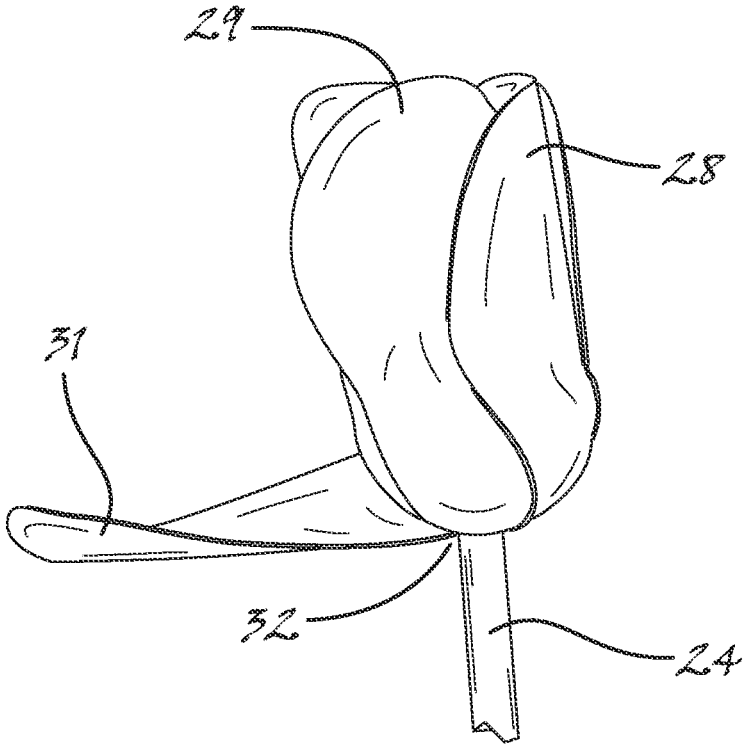
FIG. 10 shows, in a side perspective view corresponding to that of FIGS. 5 through 9, details of the initial application of a first outer panel to the interior base panel as previously positioned about the base form of FIG. 1.
Figure 11:
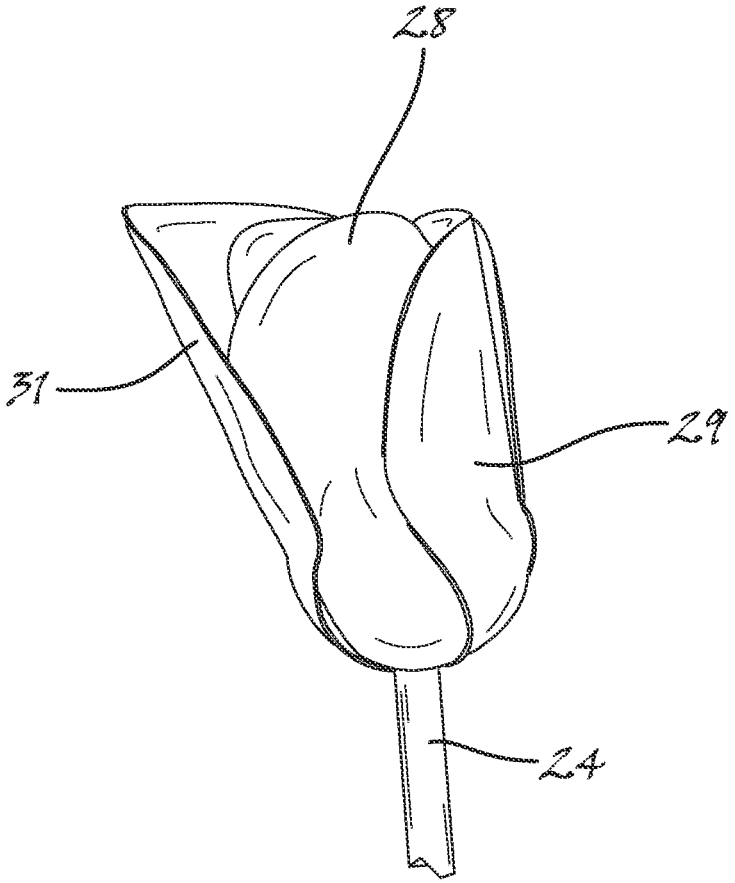
FIG. 11 shows, in a side perspective view corresponding to that of FIGS. 5 through 10, additional details of the application of the first outer panel to the interior base panel.
Figure 12:
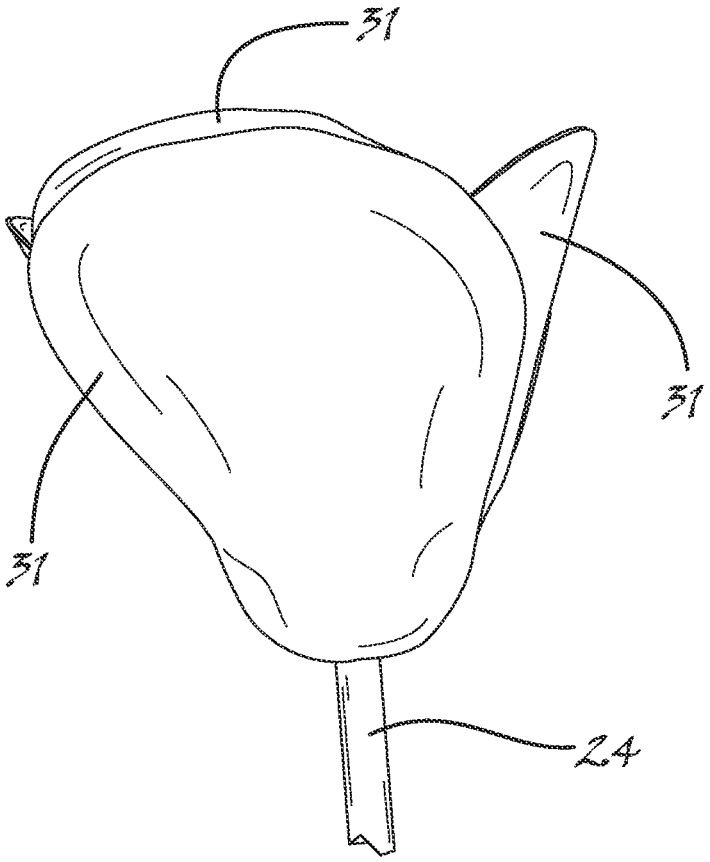
FIG. 12 shows, in a side perspective view corresponding to that of FIGS. 5 through 11, the state of the construction of the prop flower where all outer panels are initially applied about and to the interior base panel preparatory to final manipulation of the interior base panel and outer panels to realistically form the petals of the prop flower.

Turning then to FIG. 10, the initial attachment of a first outer panel 31 is shown. As before, the lower portion of the outer panel 31, as well as a corresponding area of the exteriorly accessible section of the previously applied interior, base panel 28, is treated with the selected contact type spray adhesive and the arcuate notch 32 of the outer panel 31 is position as shown adjacent the mounting pole 24. With the outer panel 31 so positioned, the outer panel 31 is then smoothed over and about at least the area of the interior, base panel 28 covering the base form 21, as particularly depicted in FIG. 11. As will be appreciated by those of ordinary skill in the art in light of this exemplary description, heated air is utilized as required to facilitate formation. In any case, successive outer panels 31, numbering about 7 or 8 according to this exemplary implementation, are then similarly applied around and about the structure in progress to result in the structure depicted in FIG. 12. The structure thus far completed is then allowed to rest as necessary for the contact type spray adhesive to dry and close.

Figure 13:
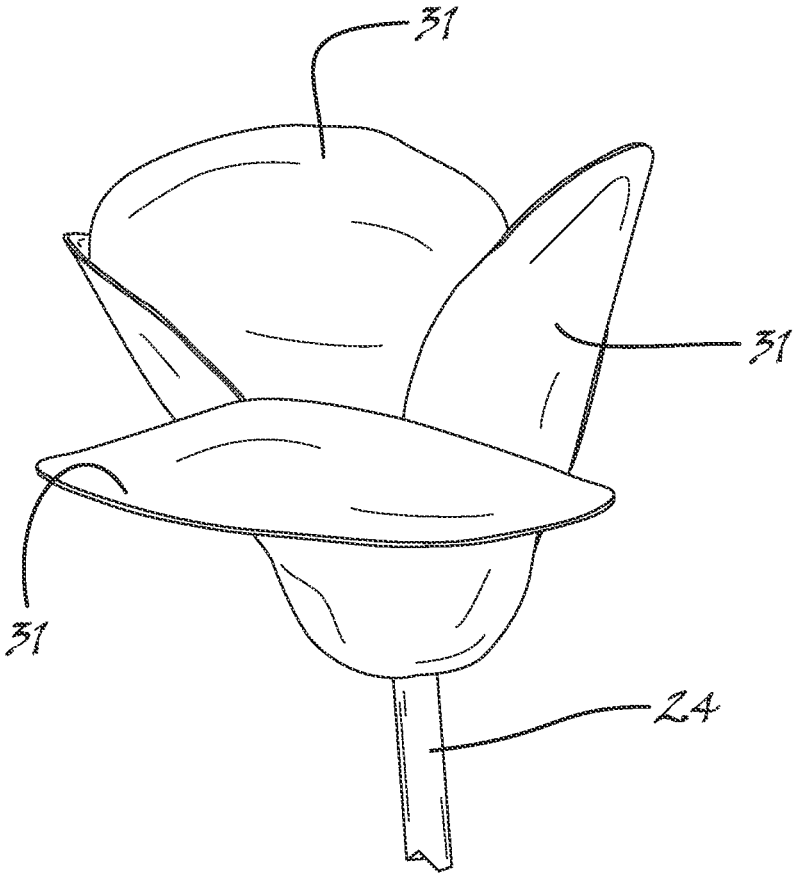
FIG. 13 shows, in a side perspective view corresponding to that of FIGS. 5 through 12, the initial step in the manipulation of an outer panel to form the petals of the prop flower.
Figure 14:
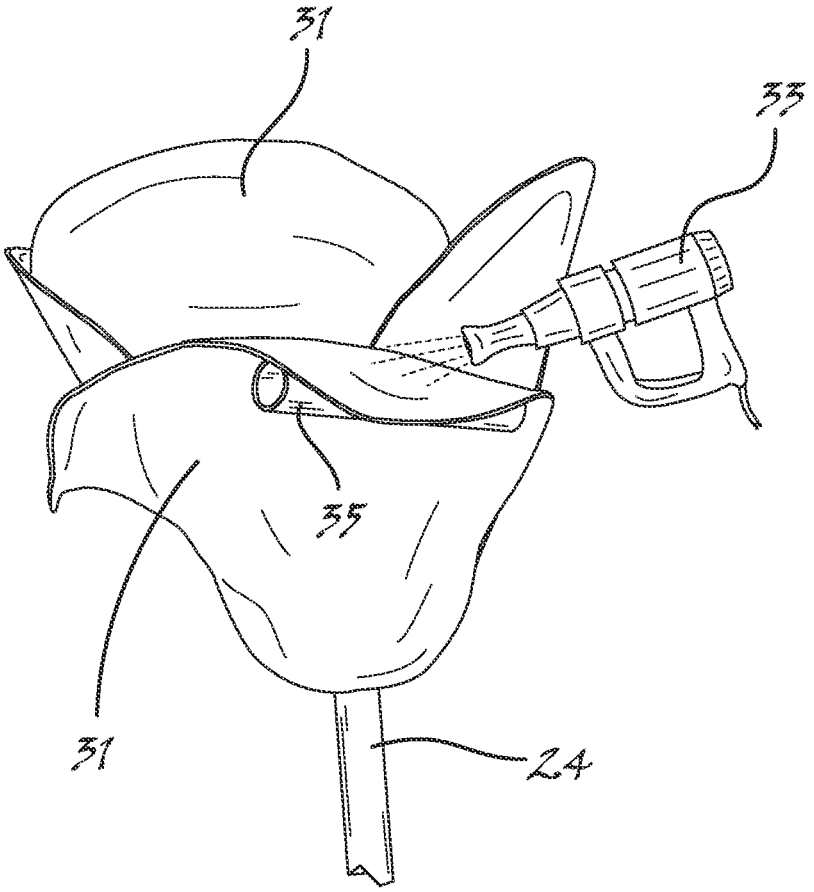
FIG. 14 shows, in a side perspective view corresponding to that of FIGS. 5 through 13, various additional details of manipulation of an outer panel to form the petals of the prop flower and, in particular, the heating of a portion of the previously depicted outer panel about a solid form.
Figure 15:
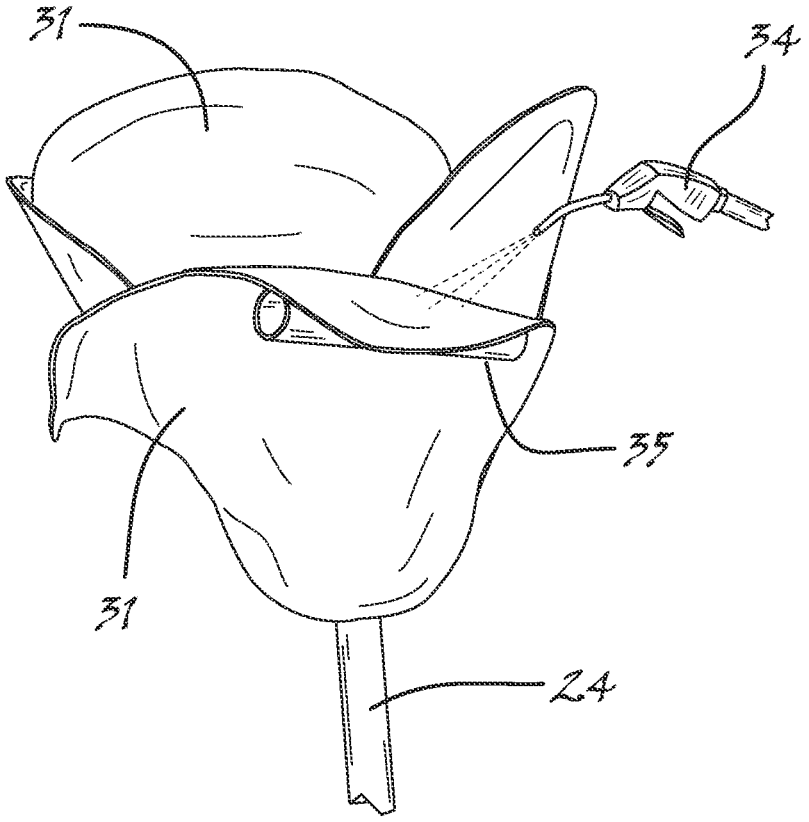
FIG. 15 shows, in a side perspective view corresponding to that of FIGS. 5 through 14, various additional details of manipulation of an outer panel to form the petals of the prop flower and, in particular, the cooling of the previously depicted portion of the outer panel about the previously depicted solid form.
Figure 16:
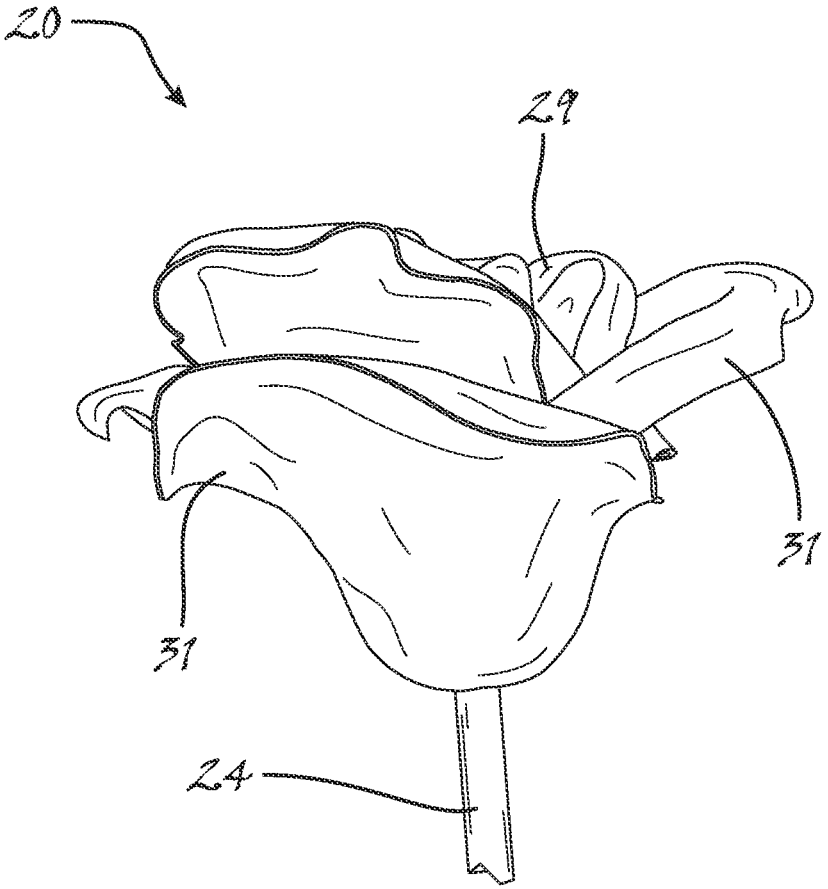
FIG. 16 shows, in a side perspective view corresponding to that of FIGS. 5 through 15, the finally formed prop flower of the present invention as manufactured according to the preferred method of the present invention.
Figure 17:
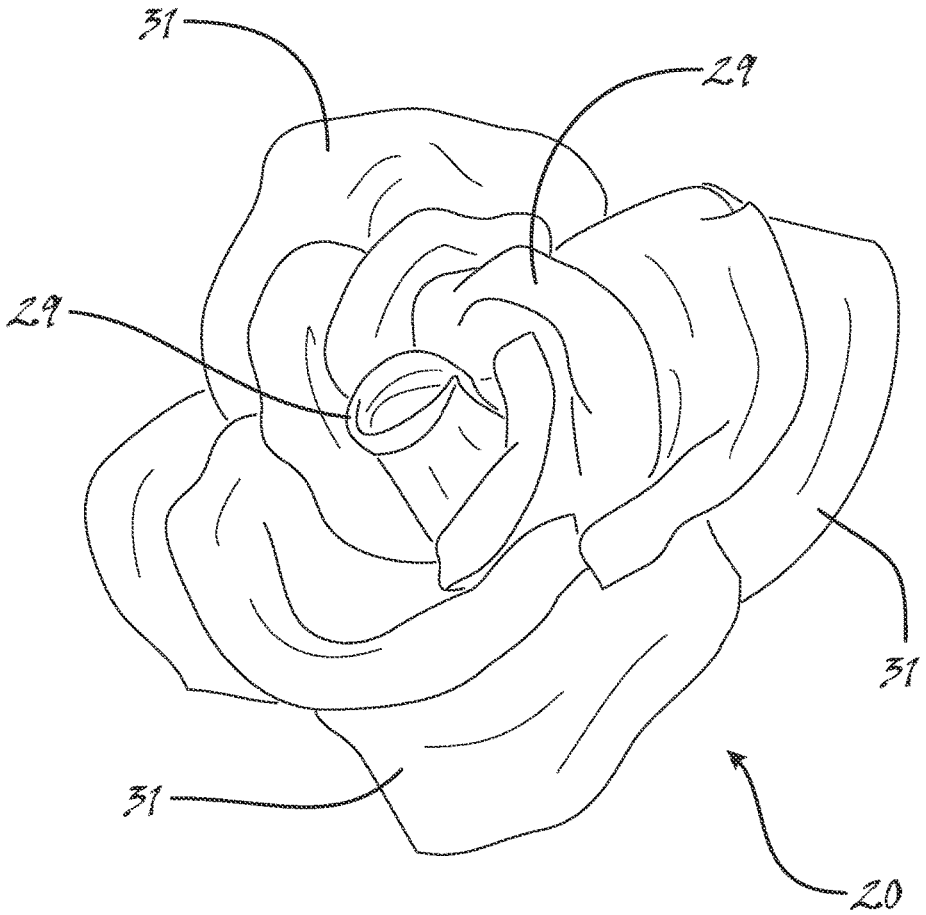
FIG. 17 shows, in a top perspective view, the prop flower of FIG. 16.

Referring now to FIGS. 13 through 15, in particular, the steps for final formation of the petals of the prop flower 20 are described. As shown in FIG. 13, the outer, top edge of an outermost outer panel 31 is turned outward and downward, whereafter successive, alternating applications of heated air from the heat gun 33 and ambient temperature air from a compressed air source 34 are utilized to shape and lock the shape of the petals. As an aid in this process, one or more tubular or otherwise shaped forms 35 may be provided and utilized. In any case, this process is continued until the prop flower 20 of the natural form, as depicted in FIGS. 16 and 17, is achieved.

Finally, the most preferred method of manufacture of the prop flower 20 of the present invention comprises the step of applying a flexible coating to the finally formed prop flower 20. According the most preferred implementation, the applied flexible coating should comprise a synthetic coating, which provides realistic coloring, as well as protection against the elements, while also enabling natural movement of the individual petals of the prop flower. This natural movement not only provides additional realism, but also generally precludes cracking and the like to be expected with ordinary paints and the like. The flexible coating is preferably applied by spraying, although it can also be brushed on. Although any substantially equivalent flexible coating may be utilized in a particular implementation, Applicant has found suitable the synthetic rubber coating commercially available from Plasti Dip International, Inc. of Blaine, Minn. under its well-known trademark "PLASTI DIP."

In use, the resultant prop flower 20, which is weather resistant and very realistic, is simply transported to any desired location, indoors or out of doors, and secured in place by any conventional means using the provided mounting pole 24 as a convenient point of attachment.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. In any case, because the scope of the present invention is much broader than any particular embodiment, the foregoing detailed description should not be construed as a limitation of the scope of the present invention, which is limited only by the claims appended hereto.

What is claimed is:

1. A method for construction of a realistically formed and moisture resistant prop flower comprising the steps of:

providing a rigid ball, said ball being dependently supported atop a tubular member extending therefrom;

affixing an interior, base panel over and about said tubular member and said rigid ball and, thereafter, affixing a plurality of outer panels over and about said interior, base panel, wherein said interior, base panel and each said outer panel comprises a fine, closed-cell foam material having a substantially smooth outer surface; and shaping at least a portion of said interior, base panel and each said outer panel into petals by alternately applying heated air and ambient temperature air to each said portion being shaped.

2. The method for construction of a prop flower as recited in claim 1, wherein said fine, closed-cell foam material comprises cross-linked polyethylene foam.

3. The method for construction of a prop flower as recited in claim 2, wherein said interior, base panel comprises a trefoil.

4. The method for construction of a prop flower as recited in claim 2, wherein said interior, base panel comprises a quatrefoil.

5. The method for construction of a prop flower as recited in claim 2, wherein said interior, base panel comprises a cinquefoil.

6. The method for construction of a prop flower as recited in claim 5, wherein said rigid ball comprises a plastic material.

7. The method for construction of a prop flower as recited in claim 6, wherein said plastic material comprises closed-cell extruded polystyrene foam.

8. The method for construction of a prop flower as recited in claim 7, wherein said tubular member comprises polyvinyl chloride.

9. The method for construction of a prop flower as recited in claim 5, said method for construction further comprising the step, following said shaping step, of applying a flexible coating to exposed areas of said interior, base panel and each said outer panel.

10. The method for construction of a prop flower as recited in claim 9, wherein said flexible coating comprises a synthetic rubber coating.

* * * * *